US010125005B2

(12) United States Patent
Cohen

(10) Patent No.: US 10,125,005 B2
(45) Date of Patent: Nov. 13, 2018

(54) WATER BOTTLE LIFTING AND ROTATING DEVICE

(71) Applicant: Morris Bernard Cohen, Laguna Woods, CA (US)

(72) Inventor: Morris Bernard Cohen, Laguna Woods, CA (US)

( * ) Notice: Subject to any disclaimer, the term of this patent is extended or adjusted under 35 U.S.C. 154(b) by 33 days.

(21) Appl. No.: 15/343,122

(22) Filed: Nov. 3, 2016

(65) Prior Publication Data

US 2018/0118553 A1 May 3, 2018

(51) Int. Cl.

| | |
|---|---|
| ***B66F 9/18*** | (2006.01) |
| ***B67D 3/00*** | (2006.01) |
| ***B66F 9/12*** | (2006.01) |
| ***B66F 9/075*** | (2006.01) |

(52) U.S. Cl.

CPC ..... *B67D 3/0029* (2013.01); *B66F 9/07581* (2013.01); *B66F 9/125* (2013.01); *B66F 9/18* (2013.01)

(58) Field of Classification Search

CPC ..... B66F 9/187; B66F 9/07581; B66F 9/125
USPC ..... 414/621
See application file for complete search history.

(56) References Cited

U.S. PATENT DOCUMENTS 3,868,033 A * 2/1975 Le Duff ..... B65G 65/23 414/420
4,036,382 A * 7/1977 Perry ..... B66F 9/02 414/420
5,207,550 A * 5/1993 Lehman ..... B66F 9/06 414/420
5,288,200 A * 2/1994 Burgers ..... B65G 65/23 187/283
5,379,814 A * 1/1995 Posly ..... B66F 9/06 141/351
5,406,996 A * 4/1995 Wagner ..... B66F 9/06 141/364
5,425,614 A * 6/1995 Perussi ..... B66C 23/48 141/351
5,586,692 A * 12/1996 Livengood ..... B67D 3/00 141/391
5,732,857 A * 3/1998 Yared ..... B67D 1/08 141/319
5,944,474 A * 8/1999 Cummins ..... B62B 3/104 294/119.2
6,406,248 B1 * 6/2002 McGill ..... B62B 3/008 280/47.2
6,971,410 B2 * 12/2005 Sari ..... B62B 3/104 137/565.01
8,408,420 B2 * 4/2013 Almada ..... B67D 3/0032 222/1

(Continued)

*Primary Examiner* — Jonathan Snelting
(74) *Attorney, Agent, or Firm* — Roy A Ekstrand

(57) ABSTRACT

A water bottle lifting and rotating device includes a base supporting a pair of rolling wheels and forwardly extending supports. The base further supports a vertically extending mast upon which a bottle clasp is lifted and lowered by a cable arrangement. A drive motor also supported on the base is operative in combination with the pulley and cable arrangement to raise and lower the bottle clasp and thereby raise and lower a captive water bottle. The bottle clasp supporting a water bottle is automatically rotated to an inverted position by a gear and gear rack arrangement operative between the mast and the bottle clasp.

4 Claims, 11 Drawing Sheets

(56) References Cited

U.S. PATENT DOCUMENTS

| | | | | |
|---|---|---|---|---|
| 8,640,924 | B2 * | 2/2014 | Almada | B67D 3/0032 222/146.1 |
| 2004/0265104 | A1 * | 12/2004 | Davis, Jr. | B62B 1/264 414/490 |
| 2006/0056947 | A1 * | 3/2006 | Posly | B66F 9/06 414/419 |
| 2008/0245436 | A1 * | 10/2008 | Lang | B67D 3/0032 141/2 |

* cited by examiner

WATER BOTTLE LIFTING AND ROTATING DEVICE

FIELD OF THE INVENTION

This invention relates generally to water coolers and particularly to apparatus for lifting, rotating and installing typical multiple gallon water bottles.

BACKGROUND OF THE INVENTION

One of the most common types of comfort and convenience devices located within offices and other business and work areas are known generally as "water coolers". Such devices were generally referred to as water coolers due to the objective of maintaining the dispensed water at a pleasant refreshing cool temperature. While the original name of water coolers persist, such devices have evolved somewhat and provide cooled water together with heated water and in some instances a "super hot" water capability. While a variety of water cooler designs have been provided by practitioners in the art, most utilize a multiple gallon reservoir bottle which typically holds five gallons of water and which functions as a water reservoir for the cooler. In most devices, the multiple gallon bottle is inverted and installed neck down upon the top of the water cooler device. The bottle remains inverted during use and relies upon gravity to dispense water as required.

While such multiple gallon water bottle coolers have remained popular through many years, one vexing problem has persisted. A typical multiple gallon water bottle holds five gallons of water and is heavy and difficult to lift, invert and install upon the top of the water cooler. Many office workers simply lack the strength to perform water bottle replacement.

Faced with the long term popularity of such water coolers and the difficulty of water bottle installation, practitioners in the art have endeavored to provide a variety of devices which achieve the basic function of installing a multiple gallon water upon a cooler. One example of such devices is found in U.S. Pat. No. 8,408,420 issued to Almada et al which sets forth a LIFTING AND ROTATING WATER RESERVOIR WITH ATTACHED WATER BOTTLE FOR DISPENSING OF WATER FROM WATER COOLER in which a water dispensing apparatus is installed upon the upper portion of a five gallon water reservoir and the combined structure of the five gallon water bottle and water dispensing apparatus are joined together and thereafter lifted and inverted and maintained within a supporting frame during use. The combined structure of the water bottle and water dispensing apparatus are raised within the support frame and are inverted by a gear rack inverter all of which is powered by an electric motor.

U.S. Pat. No. 8,408,420 issued to Almada et al sets forth a LIFTING AND ROTATING WATER RESERVOIR WITH ATTACHED WATER BOTTLE FOR DISPENSING OF WATER FROM WATER COOLER which is a continuation in part of U.S. Pat. No. 8,640,924 and which shows an identical apparatus.

U.S. Pat. No. 5,406,996 sets forth a water bottle lifting apparatus having a wheeled base supporting a vertical mast. A shuttle is movable upon the vertical mast and supports a clamp for gripping a typical five gallon water bottle. A pulley and cable arrangement is secured to the bottle clamp and is utilized in raising the water bottle.

U.S. Pat. No. 5,379,814 issued to Posly sets forth a WATER BOTTLE LIFTING MECHANISM having a wheeled base supporting a vertically extending frame. A shuttle is movable vertically upon the frame center member and supports a pair of bands which encircle and engage a five gallon water bottle. A lift mechanism includes an elongated threaded shaft which threadably engages the bottle supporting clamp and shuttle and is rotated by an electric drive motor and gear mechanism.

U.S. Pat. No. 3,868,033 issued to LeDuff sets forth a LIFTING TRUCK PARTICULARLY ADAPTED FOR CYLINDRICAL CONTAINERS in which a hand truck supported by a pair of wheels and defining a support base includes a vertically movable platform and lifting mechanism operative thereon. A water such as a five gallon bottle is received upon the platform and secured by a belt and neck clamp. The lifting apparatus raises the platform and the water bottle upon the hand truck.

Published US Patent application US2006/0056947 filed by Posly sets for a WATER BOTTLE LIFTING, ROTATING AND MOUNTING APPARATUS having a motorized mechanism for securely gripping the bottle, a motorized mechanism for raising and lowering the bottle and a motorized mechanism for rotationally inverting the bottle to enable a person with limited physical strength to lift and move a full upright bottle from the floor, invert the bottle, and place it down into the well of the water cooler. The mechanism for securing the water bottle includes a pair of articulated jaws which pivot to grip the periphery of a water bottle.

U.S. Pat. No. 4,036,382 issued to Perry et al sets forth a BOTTLE HANDLING APPARATUS in which a water bottle carrier is coupled to a vertically supporting track mechanism. The carrier supporting a water bottle is moved up the outer side of the track to a top position and then pivots over the top of the track to an inverted position above the water cooler. The water bottle is then moved downwardly on the interior side of the track for installation upon the water cooler.

U.S. Pat. No. 5,288,200 issued to Burgers et al sets forth a BOTTLED WATER INSTALLER having a wheel supported base together with a vertically extending track. The apparatus further includes a bottle receiving platform secured to a shuttle carried by the vertical track. In operation, the shuttle is moved upwardly carrying the platform and bottle vertically to the top of the track. The shuttle passed over the upper end of the track inverting the platform and water bottle for installation within a water cooler.

Published US Patent application US2008/0245436 filed by Lang sets forth a BEVERAGE DISPENSER WITH APPARATUS FOR LIFTING AND TRANSFERRING LOADS having a telescoping vertical support which raises a platform bearing a water bottle to an upright position above the water cooler. The vertical support is formed of a plurality of extending frame members.

Published US Patent application US2004/0265104 filed by Davis, Jr. sets forth a CONTAINER TRANSPORTING DEVICE includes a hand truck having a bottle supporting platform together with a platform raising apparatus. U.S. Pat. No. 5,406,996 issued to Wagner et al and U.S. Pat. No. 5,425,614 issued to Perussi et al set forth further examples of hand truck bottle raising and inverting apparatus.

Several related prior art patents and applications set forth water bottle lifting and inverting apparatus in which a pivoting bottle support is the primary mechanism for lifting and inverting the water bottle. Examples of such devices are found in U.S. Pat. No. 5,732,857 issued to Yared; U.S. Pat. No. 5,586,692 issued to Livengood; and Published US patent application US2009/0304487.

While the foregoing described prior art devices have to some extent improved the art and in some instances enjoyed moderate commercial success, there remains nonetheless a continuing unresolved need in the art for an improved water bottle lifting and installing device which is efficient, low in cost and easy to use when operated by people of limited physical strength.

SUMMARY OF THE INVENTION

Accordingly, it is a general object of the present invention to provide an improved water bottle lifting and rotating device. It is a more particular object of the present invention to provide an improved water bottle lifting and rotating device which may be operated by persons of limited physical strength and dexterity. It is a still more particular object of the present invention to provide an improved water bottle lifting and rotating device which is compact for storage and which is low in cost.

In accordance with the present invention, there is provided a water bottle lifting and rotating device comprising; a base having a pair of rotatable wheels and a pair of extending base supports; a mast having a lower end secured to the base, an upper end and a hallow interior passage, the mast extending vertically from the base; a gear drive supported upon the base having a drive pulley supported within the interior passage; a motor coupled to the gear drive operative to cause rotation of the drive pulley; an upper pulley rotatably supported at the upper end of the mast; a cable having a portion joined to and wound upon the drive pulley, a portion extending upwardly through the interior passage, a portion passing over the upper pulley, a descending portion and a cable end; a shuttle moveable within the interior passage and having a rotatable shafts; a gear supported upon the shafts; a bottle clasp having a clasp support joined to the shaft, a pair of clasp jaws pivotally joined to the clasp support and an over-center clasp latch; and a gear rack segment positioned upon the mast in alignment with the gear, the cable end being attached to the shuttle such that the shuttle and the bottle clasp are raised and lowered as the motor is activated.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS OF THE INVENTION

Figure 1:
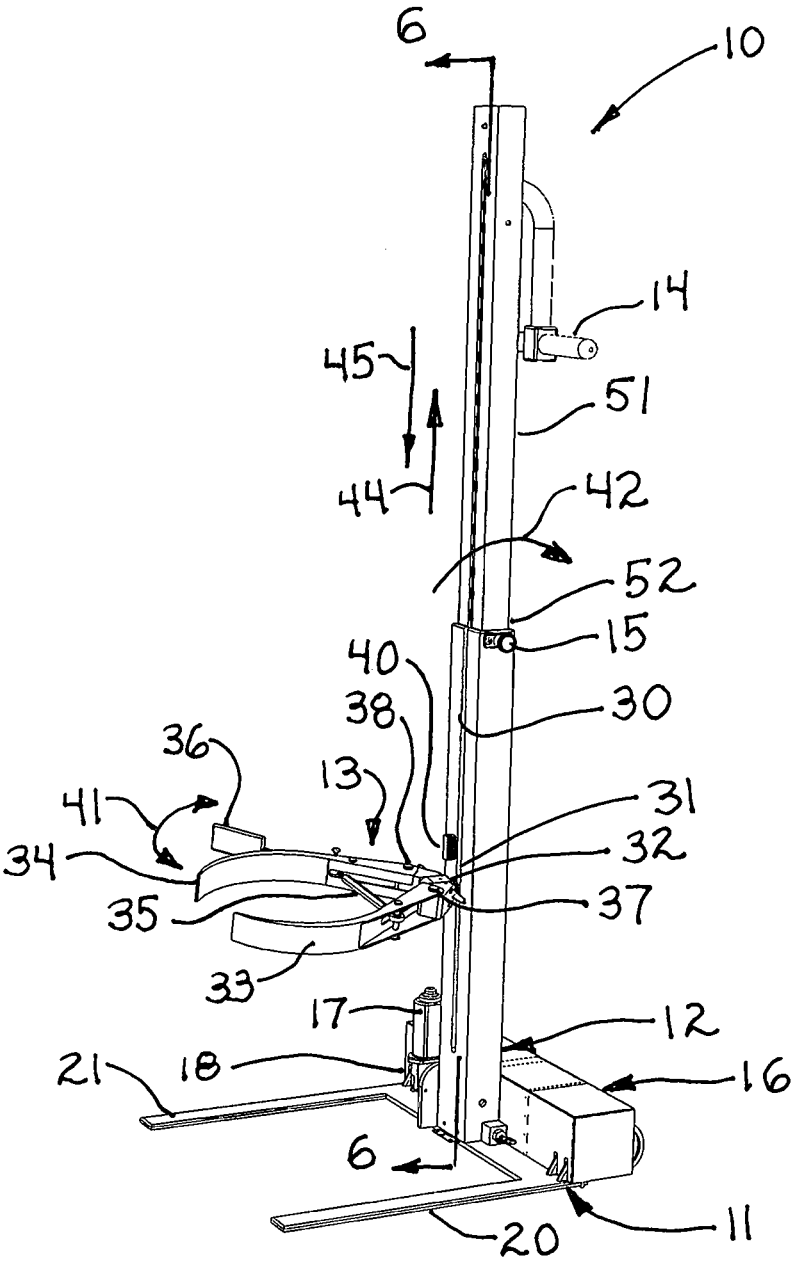
FIG. 1 sets forth a front perspective view of a water bottle lifting and rotating device constructed in accordance with the present invention.

FIG. 1 sets forth a front perspective view of a water bottle lifting and rotating device constructed in accordance with the present invention and generally referenced by numeral 10. Device 10 includes a support base 11 having a pair of forwardly extending base supports 20 and 21. Base 11 further supports a housing 16 together with a motor 17 and a gear drive mechanism 18. Base 11 also support the lower end of a vertical mast 12. Vertical mast 12 is formed of a lower mast segment 50 and an upper mast segment 51. Mast segments 50 and 51 form generally rectangular cross section members fabricated of a high strength material such as steel or the like. Vertical mast 12 defines an elongated slot 30 extending upwardly from base 11 to the upper portion of mast segment 51. The interiors of mast segments 50 and 51 are hollow to facilitate the vertical movement of a shuttle 31 upwardly and downwardly within vertical mast 12. Upper segment 51 is joined to lower segment 50 by a hinge 52 (better seen in FIG. 2). A lock pin 15 engages mast segments 50 and 51 to facilitate locking mast segment 51 in an upward extension from mast segment 50 as seen in FIG. 1. Hinge 52 facilitates the pivoting movement of upper mast segment 51 in the direction indicated by arrow 42 to reduce the upward extension of vertical mast 12 for storage purposes. Lock pin 15 is drawn outwardly to release upper mast segment 51 and facilitate pivoting thereof about hinge 52.

By means set forth below in FIGS. 4 and 5 in greater detail, shuttle 31 supports an articulated bottle clasp 13 in a rotatable support. Suffice it to note here that bottle clasp 13 includes a clasp support 32 which in turn pivotally supports a pair of clasp jaws 33 and 34. A pair of hinge pins 37 and 38 pivotally joined clasp jaws 33 and 34 respectively to clasp support 32. The pivotal support of clasp jaws 33 and 34 facilitates opening and closing of bottle clasp 13 to grip the exterior of a conventional five gallon water bottle or the like (not shown). The movement both opening and closing clasp jaws 33 and 34 is controlled by a latch rod 35 extending there between together with a pivotable latch handle 36. The structure of latch handle 36 and latch rod 35 is set forth below in FIGS. 4 and 5 in greater detail. Suffice it to note here that the cooperation of latch handle 36 and latch rod 35 facilitate the establishment of a "over-center" attachment by which clasp jaws 33 and 34 grip a conventional five gallon water bottle. A handle 14 is secured to upper mast segment 51 to facilitate easy handling of device 10. As is better seen in FIG. 2, base 11 supports a pair of wheels 25 and 26. The location of wheels 25 and 26 upon base 11 facilitates the operation of device 10 in a similar fashion to that enjoyed with a conventional handle truck. Thus, with a water bottle secured within and held firmly by bottle clasp 13 in the manner described below, the user then simply grasps handle 14 and pivots device 10 rearwardly to tilt backwards upon wheels 25 and 26 (seen in FIG. 2). In this manner, device 10 supporting a conventional water bottle may then be simply wheeled into proximity with a conventional water cooler (not shown). Once device 10 is positioned adjacent a conventional water cooler, the user then energizes motor 17 which operates through gear drive 18 to raise shuttle 31 and bottle clasp 13 vertically in the direction indicated by arrow 44. In accordance with an important aspect of the present invention shown below in FIGS. 4 and 5 in greater detail, bottle clasp 13 secures a water bottle in a rotatable attachment and, as is also set forth below in FIGS. 4 and 5 in greater detail, is supported by a gear 43. Thus, as motor 17 is energized rotational power is communicated through gear drive 18 to a pulley and cable lifting arrangement shown below in FIG. 6 in greater detail. Suffice it note here that energizing motor 17 raises shuttle 31 upwardly in the direction indicated by arrow 44. As shuttle 31 and more importantly gear 43 (seen in FIG. 5) move upwardly gear 43 engages gear rack segment 40 causing bottle clasp 13 and a water bottle carried thereby (not shown) to be rotated to an inverted position. Thereafter, as motor 17 continues to be energized, shuttle 31 and bottle clasp 13 continue upwardly in the direction indicated by arrow 44 until the desired height is obtained. Thereafter, device 10 is moved into further alignment with a host water cooler (not shown) after which the direction of rotation of motor 17 is reversed causing shuttle 31 and bottle clasp 13 carrying an inverted water bottle to move downwardly in the direction indicated by arrow 45. Once sufficient downward movement has been obtained and the transported water bottle (not shown) has been deposited within the water cooler (not shown), motor 17 ceases operation and the user simply moves latch handle 36 in the manner indicated by arrow 41 to release clasp jaws 33 and 34. Device 10 is then withdrawn from proximity to the water cooler leaving an installed water bottle in proper position upon the cooler. Device 10 may then be used in a repeated fashion to secure, lift, rotate and install subsequent water bottle as desired. Alternatively, device 10 may be moved to a storage location and if desired pin 15 may be pulled to release upper mast segment 51 and allow segment 51 to be pivoted in the direction indicated by arrow 42 to facilitate storage of device 10.

It will be apparent to those skilled in the art that the structure and operation of the present invention water bottle lifting and rotating device provides an extremely simplified and low-cost apparatus for performing the lifting, rotating and installing of a heavy five gallon water bottle or the like. It will be equally apparent that the manipulation of the present invention water bottle lifting and rotating device is virtually the same as that of a conventional hand truck thereby avoiding the need for the application of substantial strength and dexterity normally attendant to the manipulation and loading of large five gallon water bottle. The use of a simplified cable and pulley drive apparatus for lifting and lowering the water bottle clasp and any water bottle secured therein provides reduced weight and simplicity of operation which in turn leads to substantial economy and ease of fabrication. Additionally, the simplified mechanism is highly efficient and provides extreme reliability as a result.

Figure 2:
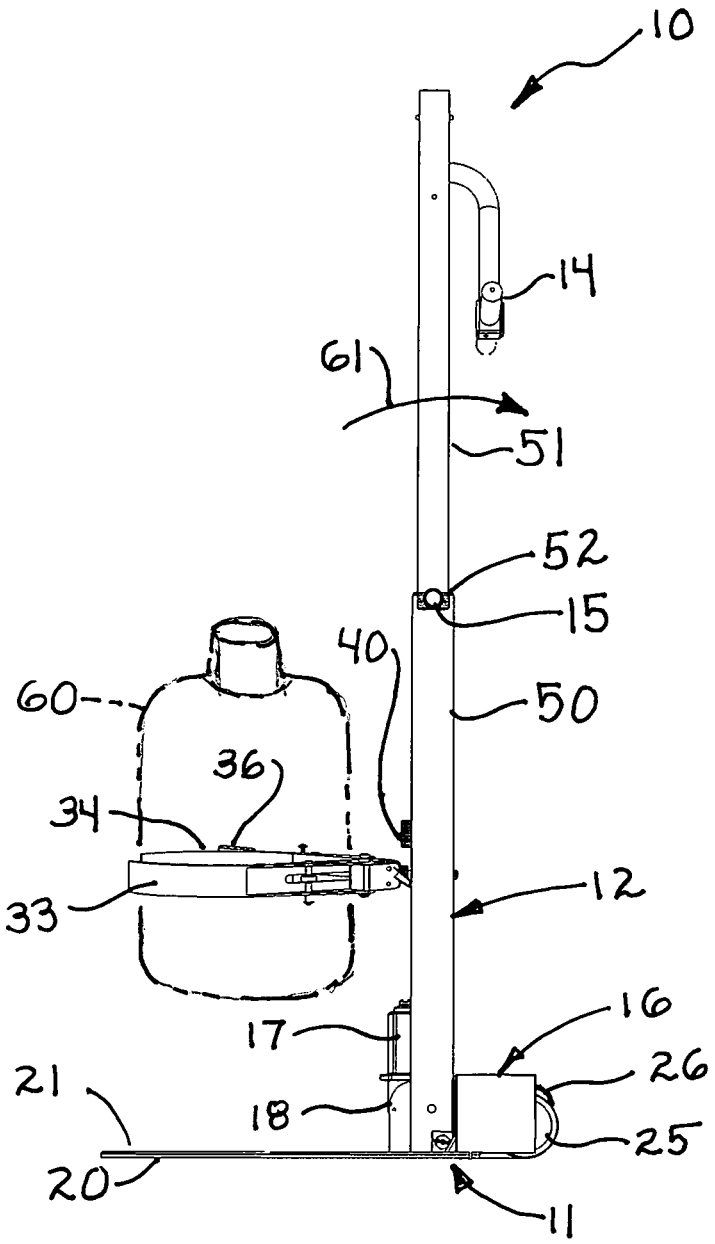
FIG. 2 sets forth a right side perspective view of the present invention water bottle lifting and rotating device.

FIG. 2 sets forth a perspective right side view of water bottle lifting and rotating device 10. In the position shown in FIG. 2, device 10 is shown supporting a conventional five gallon water bottle 60 secured within bottle clasp 13. It will be noted that five gallon water bottle 60 is shown in phantom line depiction and is representative of virtually any size or configuration of liquid container for which the present invention device may be employed. Thus, it will be understood that different sizes and different shapes of water bottle or other liquid containing bottles may be lifted and manipulated using the present invention device without departing from the spirit and scope of the present invention. However, for purposes of illustration and in anticipation of the use of the present invention device in securing and installing conventional five gallon water bottles such as water bottle 60, the descriptions which follow will continue to refer to the example of a five gallon water bottle of conventional construction with the understanding that it applies equally well to other containers.

More specifically, FIG. 2 shows water bottle lifting and rotating device 10 having a base 11 supporting a housing 16 and a pair of forwardly extending base supports 20 and 21. Device 10 further includes a vertical mast 12 extending upwardly from base 11 formed of a pair of hingedly coupled mast segments 50 and 51. Mast segment 51 further supports a handle 14. A hinge 52 hingedly couples the lower end of mast segment 51 to the upper end of mast segment 50 and is locked by a lock pin 15. A motor 17 and a gear drive 18 are further supported upon base 11. Gear drive 18 is coupled to a pulley and cable system within vertical mast 12 in the manner set forth below in FIG. 6. A bottle clasp 13 is movably and rotatably supported upon vertical mast 12 my means set forth below in greater detail. Bottle clasp 13 includes a clasp support 32 which in turn supports a pair of pivotally moveable clasp jaws 33 and 34. A pair of hinge pins 37 and 38 pivotally secure clasp jaws 33 and 34. A latch handle 36 is operative to secure closure of clasp jaws 33 and 34. Base 11 further supports a pair of wheels 25 and 26.

With water bottle 60 secured as shown in FIG. 2, the user then pivots device 10 about wheels 25 and 26 in the direction indicated by arrow 61 while grasping handle 14. At this point, the entire load of water bottle 60 is carried by wheels 25 and 26 and the user is able to operate device 10 in a similar fashion to a conventional hand truck or the like. As a result, despite the substantial weight of a full five gallon water bottle secured by bottle clasp 13, the user with very little effort is able to maneuver and transport water bottle 60. While the height at which water bottle 60 is secured during this transport or "hand-truck" manipulation of device 10 is a matter of preference, generally speaking, it is advantageous to allow water bottle 60 to remain upright and relatively low in position upon vertical mast 12 similar to the position shown in FIG. 2. This maintains the heavy weight of water bottle 60 in a low center of gravity configuration which further eases the hand-truck-like of device 10.

Figure 3:
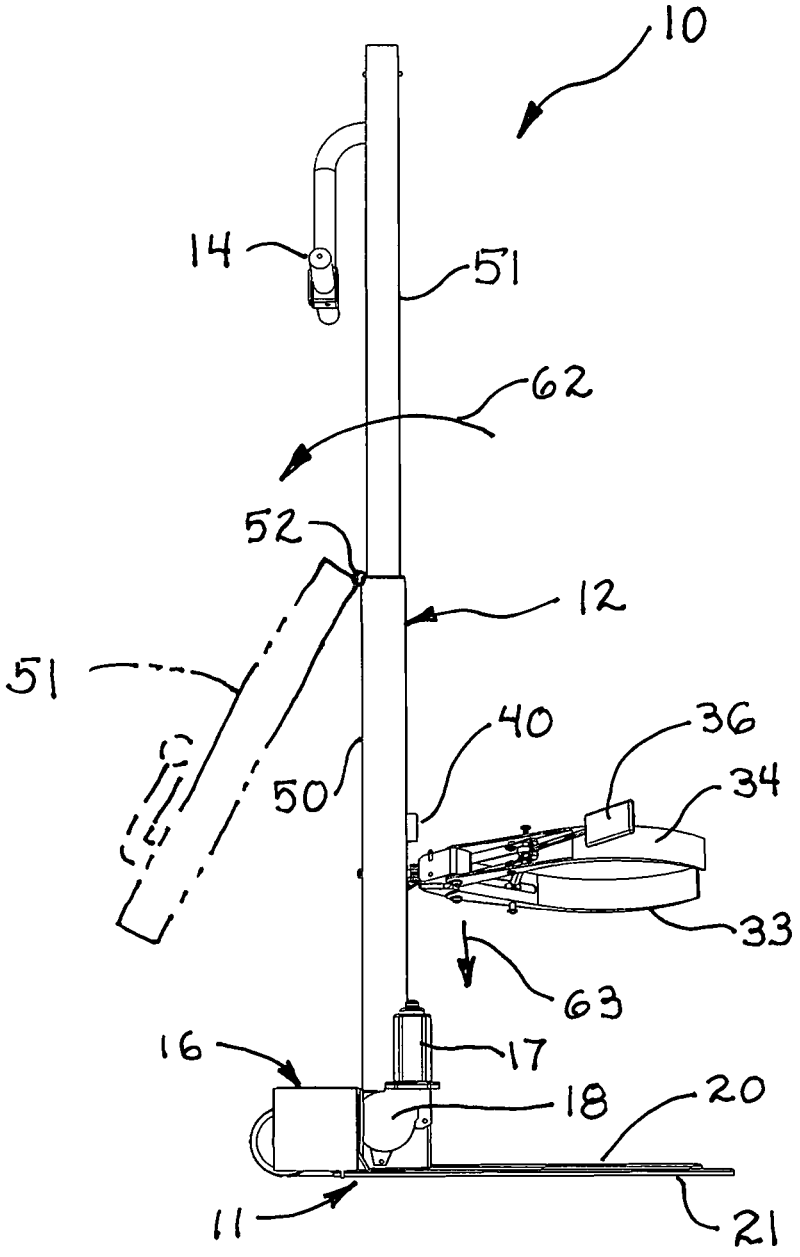
FIG. 3 sets forth a left side perspective view of the present invention water bottle lifting and rotating device.

FIG. 3 sets forth a left side view of water bottle lifting and rotating device 10. In the drawing shown in FIG. 3, device 10 is "empty" and is not shown supporting a conventional water bottle as is seen in FIG. 2. In addition, FIG. 3 shows a phantom line depiction of the folded position of upper mast segment 51 in phantom line depiction. It will be apparent from examination of FIG. 3 that the folding of upper mast segment 51 upon lower mast segment 50 substantially reduces the storage height of device 10.

More specifically, FIG. 2 shows water bottle lifting and rotating device 10 having a base 11 supporting a housing 16 and a pair of forwardly extending base supports 20 and 21. Device 10 further includes a vertical mast 12 extending upwardly from base 11 formed of a pair of hingedly coupled mast segments 50 and 51. Mast segment 51 further supports a handle 14. A hinge 52 hingedly couples the lower end of mast segment 51 to the upper end of mast segment 50 and is locked by a lock pin 15. A motor 17 and a gear drive 18 are further supported upon base 11. Gear drive 18 is coupled to a pulley and cable system within vertical mast 12 in the manner set forth below in FIG. 6. A bottle clasp 13 is movably and rotatably supported upon vertical mast 12 my means set forth below in greater detail. Bottle clasp 13 includes a clasp support 32 which in turn supports a pair of pivotally moveable clasp jaws 33 and 34. A pair of hinge pins 37 and 38 pivotally secure clasp jaws 33 and 34. A latch handle 36 is operative to secure closure of clasp jaws 33 and 34. Base 11 further supports a pair of wheels 25 and 26.

While the position of bottle clasp 13 during this storage configuration is to some extent a matter of user choice, it has often been found advantageous to move bottle clasp 13 in the direction indicated by arrow 63 to its lowest position further compacting device 10 for convenient storage. It will be apparent to those skilled in the art that the present invention water bottle lifting and rotating device is extremely compact in its folded configuration and thus takes up little space in a storage location such as a utility closet or the like. This greatly enhances the utility and appeal of the present invention device.

Figure 4:
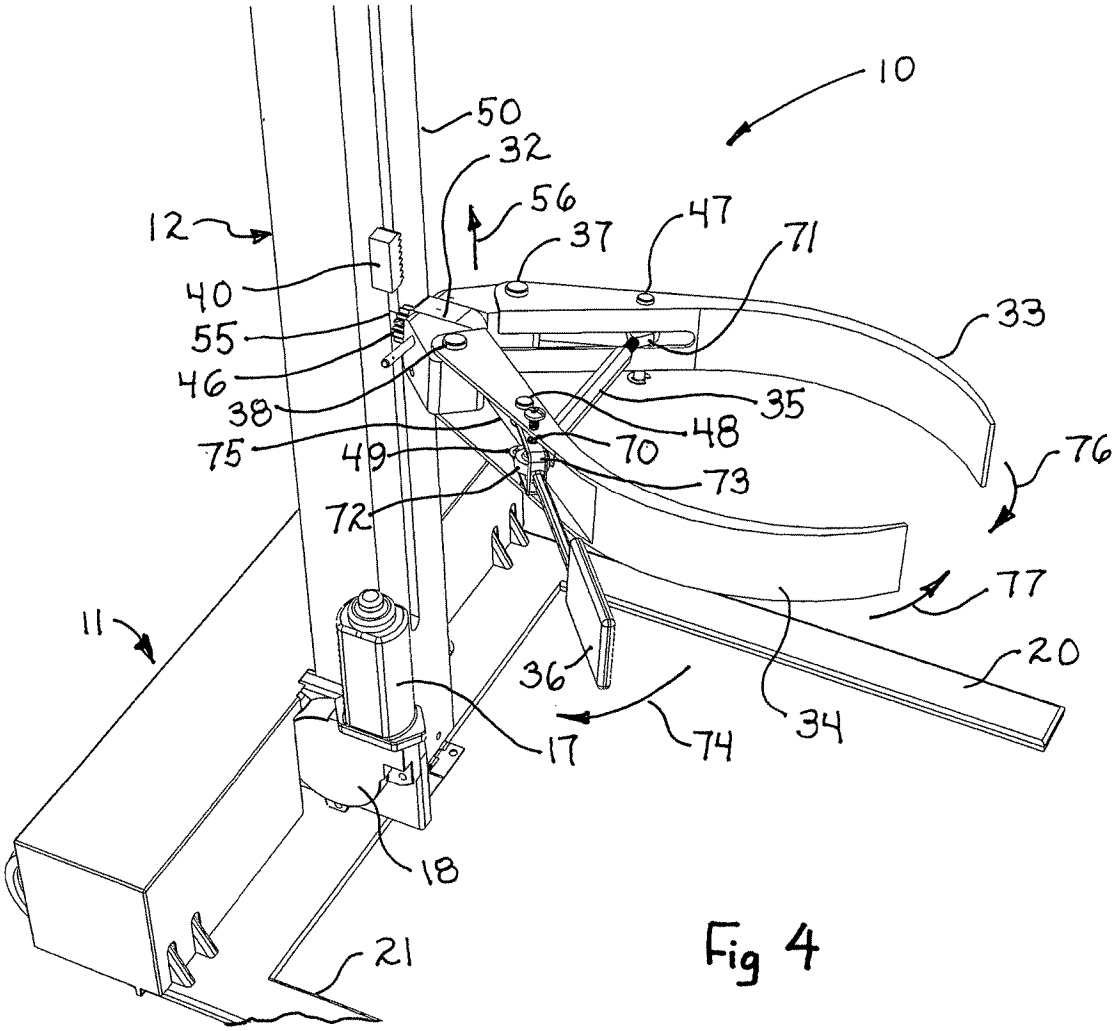
FIG. 4 sets forth a partial perspective enlarged view of the water bottle clamping apparatus of the present invention water bottle lifting and rotating device.
Figure 6:
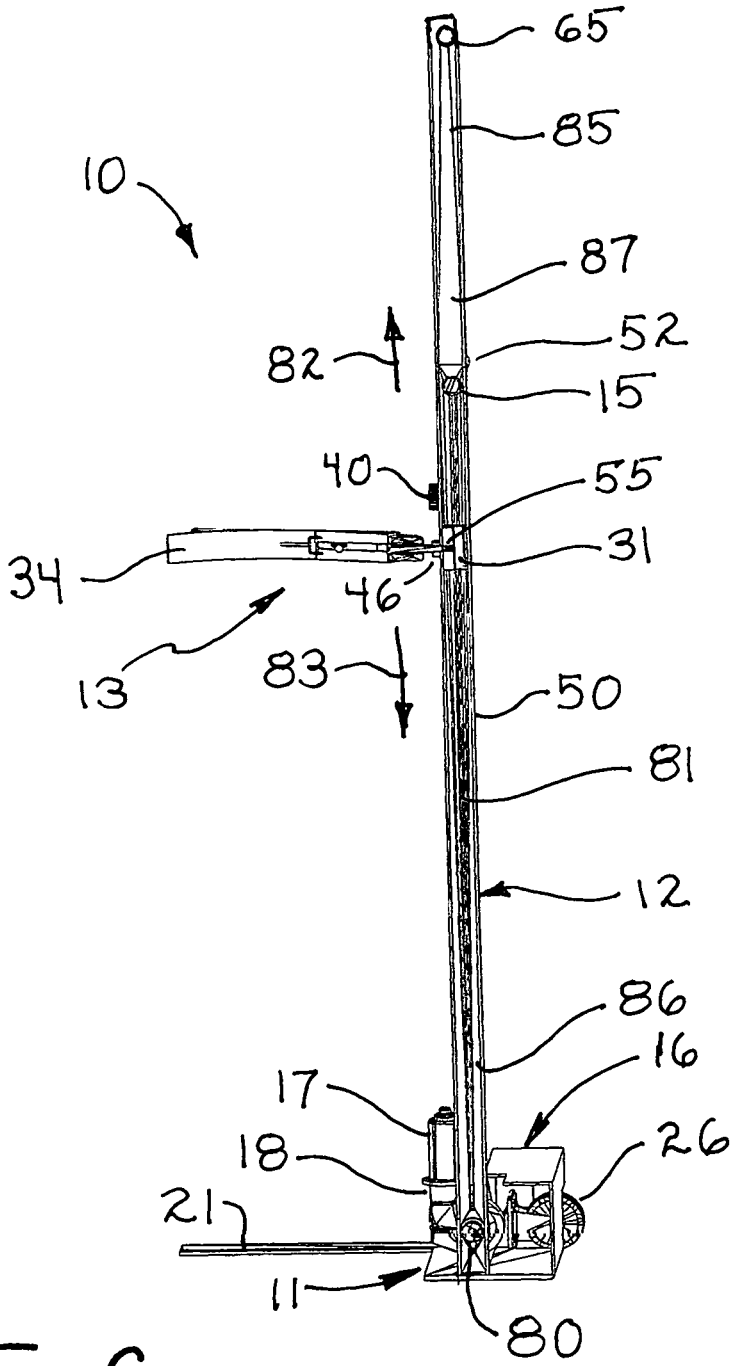
FIG. 6 sets forth a section view of the present invention water bottle lifting and rotating device taken along section lines 6-6 in FIG. 1.

FIG. 4 sets forth a partial perspective view of water bottle lifting and rotating device 10 with particular focus upon the structure of bottle clasp 13. As described above, water bottle lifting and rotating device 10 includes a base 11 having a forwardly extending base support 20 and further supporting a motor 17. As is also described above, base 11 further supports a vertical mast 12 having a lower mast segment 50 joined to and extending upwardly from base 11. Mast segment 50 defines slot 30 and as is better seen in FIG. 6, is hollow facilitating the vertical movement within mast 12 of a shuttle 31 which in turn support a shaft 55 extending through slot 30. Returning to FIG. 4, shaft 55 extending through slot 30 further supports a gear 46.

A bottle clasp generally referenced by numeral 13 includes a clasp support 32 joined to gear 46 and supported by shaft 55. Shaft 55 is rotatably supported by shuttle 31 (seen in FIG. 6) while gear 46 is fixed to clasp support 32. Thus, rotation of gear 46 upon shaft 55 causes a corresponding rotation of clasp support 32. Bottle clasp 13 further includes a pair of curved clasp jaws 33 and 34 pivotally secured to clasp support 32 by a pair of pivot pins 37 and 38 respectively. A latch rod 35 includes an end 71 pivotally secured to clasp jaw 33 by a pin 47. Latch rod 35 further includes an end 72. Bottle clasp 13 further includes a handle 36 having a yolk 73 secured thereto. Yolk 73 is pivotally secured to clasp jaw 34 by a pair of pins 48 and 49. End 72 of latch rod 35 is received within yolk 73 and pivotally secured thereto by a pin 70.

In operation, with handle 36 positioned as shown in FIG. 4, clasp jaws 33 and 34 are sufficiently open to facilitate the lowering of bottle clasp 13 onto a water bottle such as a five gallon water bottle. Once bottle clasp 13 is correctly positioned upon the to-be-engaged water bottle, the user moves handle 36 in the direction indicated by arrow 74. As handle 36 moves in the direction indicated by arrow 74, an alignment is reached as indicated by axis 75. In this alignment, pin 70 of yolk 73 and pin 48 are brought into alignment which moves clasp jaws 33 and 34 inwardly as indicated by arrows 76 and 77 respectively tightly gripping the water bottle. With handle 36 aligned with axis 75 the movement of handle 36 has reached the "centered" positioned. This also defines the tightest grasp of handles 33 and 34 which is applied to the water bottle. Thereafter, the user continues to move handle 36 in the direction of arrow 74 beyond axis 75. This further movement of handle 36 provides an "over-center" movement of handle 36 slightly relaxing the inward grasp of clasp jaws 33 and 34. The use of this over-center grasp of bottle clasp 13 firmly secures and locks jaws 33 and 34 upon the water bottle in a simple single direction movement of handle 36. Once the water bottle is secured between clasp jaws 33 and 34, motor 17 may be activated to raise shuttle 31 (seen in FIG. 6) within mast segment 50 to lift the water bottle. The operation of motor 17 in lifting and lower bottle clasp 13 is set forth below in FIG. 6 in greater detail. Suffice it to note here that shuttle 31 (seen in FIG. 6) is raised which in turn raises bottle clasp 13 upwardly upon mast segment 50 in the direction indicated by arrow 56. As bottle clasp 13 rises, gear 46 engages gear rack 40 supported upon mast segment 50. The engagement of gear 46 upon gear rack segment 40 rotates bottle clasp 13 and the bottle secured therein. The length of gear rack 40 is selected with respect to the diameter of gear 46 to ensure that bottle clasp 13 undergoes a one hundred eighty degree rotation to an inverted position. As motor 17 continues to lift bottle clasp 13 beyond the engagement of gear 46 within gear rack segment 40, the engagement thereof separates and no further rotation of bottle clasp 13 occurs. Thus, as motor 17 continues to lift, bottle clasp 13 it remains in its bottle inverting position. This facilitates the eventual loading of the inverted water bottle into a host water cooler.

Figure 5:
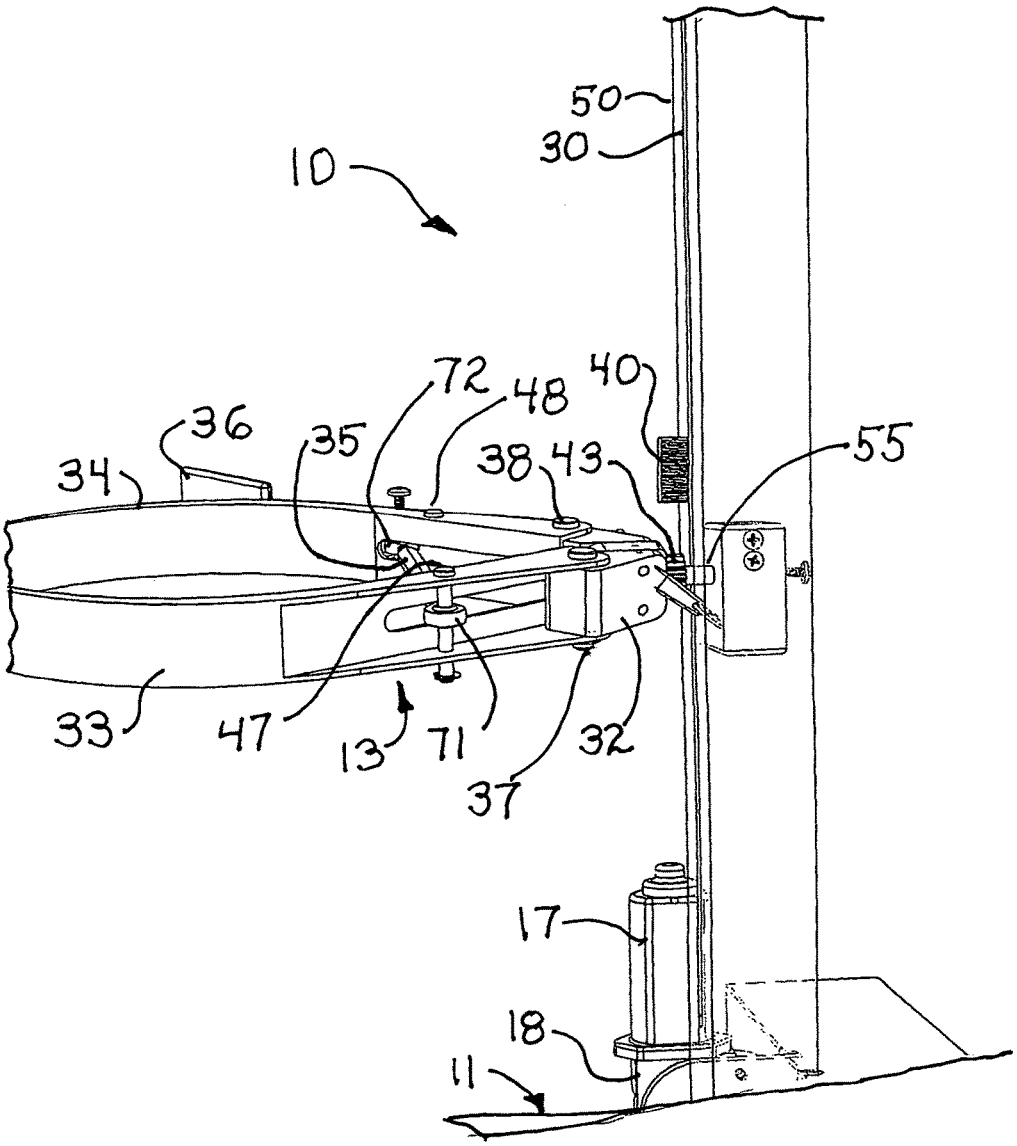
FIG. 5 sets forth a partial side view of the present invention water bottle lifting and rotating device.

FIG. 5 sets forth a partial perspective view of the present invention water bottle lifting and rotating device. As described above, device 10 includes a base 11 supporting a motor 17 and a gear drive 18. Base 11 further supports a vertically extending mast segment 50 which in turn defines a slot 30. As is better seen in FIG. 6, device 10 further includes a shuttle 31 movable within the interior of mast segment 50. Shuttle 31 supports a rotatable shaft 55 which extends through slot 30. Shaft 55 is joined to a clasp support 32 which in turn supports a pair of clasp jaws 33 and 34. A gear 43 is secured to support 32 upon shaft 55. A pair of pivot pins 37 and 38 pivotally secured jaws 33 and 34 respectively to clasp support 32. A latch bar 35 includes an end 71 pivotally secured to clasp jaw 33 by a pin 47 and end 72 which, as is better seen in FIG. 4 is joined to handle 36 which in turn is pivotally secured to clasp jaw 34 by a pin 48. A gear rack segment 40 is supported upon the front surface of mast segment 50.

FIG. 6 sets forth a section view of device 10 taken along section lines 6-6 therein. As described above, device 10 includes a base 11 having a support 21 and a housing 16 further supports a motor 17 and a gear drive 18. As is also described above, base 11 further supports a vertically extending mast 12 formed of a lower mast segment 50 and an upper mast segment 51. Mast segment 50 defines an interior passage 86 while mast segment 51 defines an interior passage 87. A rotatable pulley 65 is supported at the upper end of mast segment 51. Mast segments 50 and 51 are joined by a hinge 52 and maintained in vertical alignment by an elongated spring 81 extending from the lower end of mast segment 50 to the lower end of mast segment 51. A lock pin 15 secures the vertical alignment of mast segments 50 and 51. Gear drive 18 includes a drive pulley 80 supported within interior passage 86 of mast segment 50. A shuttle 31 is movable within interior passages 86 and 87 and includes a rotatable shaft 55 extending to support a bottle clasp 13 which includes a clasp jaw 34. A gear 46 is joined to bottle clasp 13 as described above and to shaft 55. As described above, gear 46 interacts with a gear rack segment 40 supported upon mast segment 50 to provide bottle inversion as is also described above.

Base 11 further supports a housing 16 within which a wheel 26 is supported. In operation, an elongated cable 85 is secured at one end to drive pulley 80 and is wound about drive pulley 80 for several turns. Thereafter, cable 85 extends upwardly through interior passages 86 and 87 and passes over pulley 65. After passing over pulley 65, cable 85 descends downwardly through passages 87 and 86 to engage and be secured to shuttle 31. In this manner, the cooperation of drive pulley 80 which rotates in response to the action of motor 17 and gear drive 18 is able to rotate and lift shuttle 31 upwardly in the direction indicated by arrow 82. As drive pulley is rotated by motor 17 and gear drive 18 in a first direction, cable 85 is additionally wound upon drive pulley 80 which in turn draws shuttle 31 upwardly in the direction indicated by arrow 82. Conversely, rotation of drive pulley 80 in the opposite direction plays-out a portion of cable 85 wound upon drive pulley 80 allowing shuttle 31 to move downwardly in the direction indicated by arrow 83. Thus, as motor 17 is rotated in a first direction, cable 85 is wound upon drive pulley 80 lifting shuttle 31 and bottle clasp 13. Conversely, as motor 17 is reversed in direction, drive pulley 80 is turned in a reverse direction unwinding a portion of cable 85 from drive pulley 80 which allows shuttle 31 under the influence of gravity to move downwardly and lower bottle clasp 13.

Figure 7:
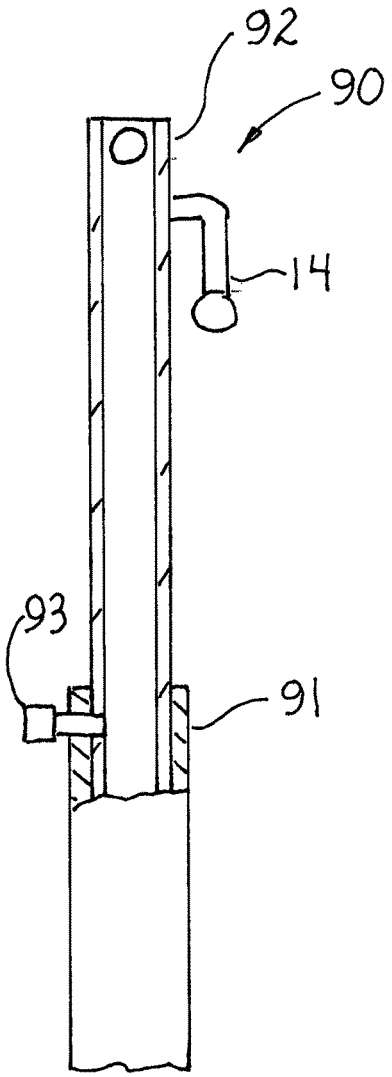
FIG. 7 sets forth a partial view of an alternate embodiment of the present invention water bottle lifting and rotating device.

FIG. 7 sets forth a partial section view of an alternate embodiment of the present invention generally referenced by numeral 90. With the exception of the telescoping mast apparatus shown in FIG. 7, it will be understood that the remainder of water bottle lifting and rotating device 90 is substantially identical to device 10 set forth and described above. The exception to this identity is found in the use of a telescoping mast segment pair 91 and 92 to provide for reduction of the overall height of device 90 in the manner shown above in FIG. 3. It will be recalled that the embodiment shown in FIG. 3 utilizes a hinged segment pair for the vertical mast. In contrast, the embodiment shown in FIG. 7 utilizes a larger diameter lower mast segment 91 which telescoping receives a smaller diameter upper mast segment 92. A lock pin 93 secures mast segment 92 in its fully raised position and is pulled outwardly to release the latch of mast segment 92 and allow it to descend into lower mast segment 91. A handle 14 is secured to upper mast segment 92.

Figure 8:
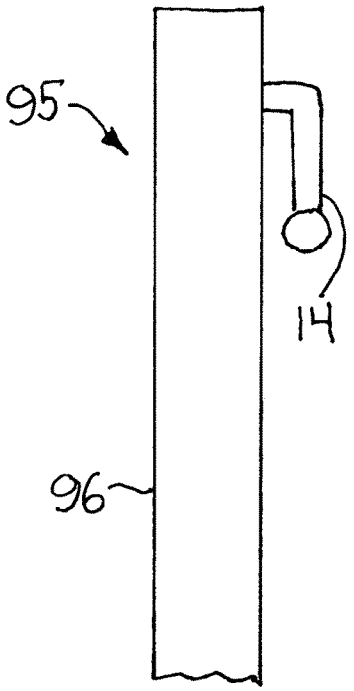
FIG. 8 sets forth a partial view of an alternate embodiment of the present invention water bottle lifting and rotating device.

FIG. 8 sets forth a partial view of a further alternate embodiment of the present invention water bottle lifting and rotating device generally referenced by numeral 95. Device 95 will be understood to be substantially identical to device 10 set forth above. Device 95 does not utilize a reduced mast segment height for storage purposes. Accordingly, vertical mast 96 of device 95 is formed as a single element and does not provide height reduction in the manner achieved by devices 90 (seen in FIG. 7) and 10 (seen in FIG. 3). A handle 14 is joined to the upper portion of mast 96 to facilitate the above-described hand truck operation.

Figure 9:
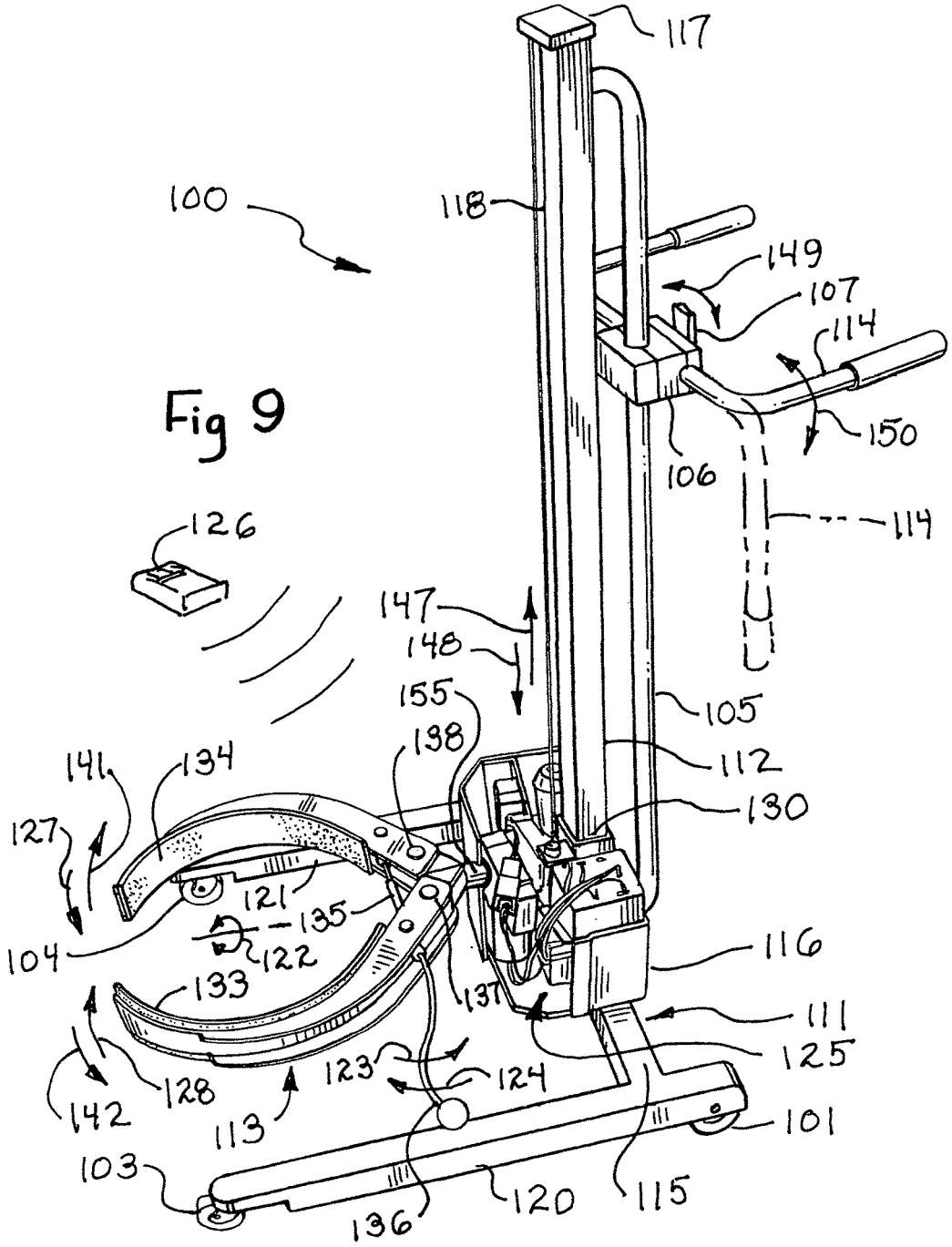
FIG. 9 sets forth a front perspective view of an alternate embodiment of the present invention water bottle lifting and rotating device.

FIG. 9 sets forth a perspective view of an alternate embodiment of the present invention water bottle lifting and a rotating device generally referenced by numeral 100. Water bottle lifting and rotating device includes a base 111 formed of a pair of lateral supports 120 and 121 joined by a cross member 115. Support 120 includes a rear wheel 101 and a front caster 103. Support 121 includes a rear wheel 102 (not shown) and a front caster 104. Water bottle lifting and rotating device 100 further includes a vertical mast 112 defining a generally square cross-section and extending upwardly from cross member 115. Vertical mast 112 supports a top cap 117 at the upper and thereof. In the preferred fabrication of the present invention, the lower end of vertical mast 112 is joined to the center of cross member 115 by a conventional weld 119 shown in FIG. 14. A handle shaft 105 is joined to the upper rear surface of vertical mast 112 near top cap 117 and extends downwardly in a generally parallel relationship to vertical mast 112. The bottom and of handle shaft 105 is joined to cross member 115 by a conventional attachment (not shown) such as welding or the like. A handle clamp 106 is supported upon handle shaft 105 and is movable vertically upon handle shaft 105. A generally U-shaped handle 114 is supported by handle clamp 106. Handle clamp 106 supports a handle clasp lever 107 which is pivotable in the manner indicated by arrows 149. Handle clamp lever 107 is used to tighten handle clamp 106 and secure the position of handle clamp 106 upon handle shaft 105 and to secure the rotational position of handle 114. Handle 114 is pivotable upon handle clamp 106 in the manner indicated by arrows 150 and may be pivoted downwardly to the lowered position shown in phantom line depiction.

Water bottle lifting and rotating device 100 further includes a control unit 125 supported within a housing enclosure 116. Housing enclosure 116 includes a mast sleeve 130 through which vertical mast 112 extends. Mast sleeve 130 is integrally formed with housing 116 and is slidably movable upon vertical mast 112 allowing control unit 125 to be raised and lowered upon vertical mast 112.

Figure 10:
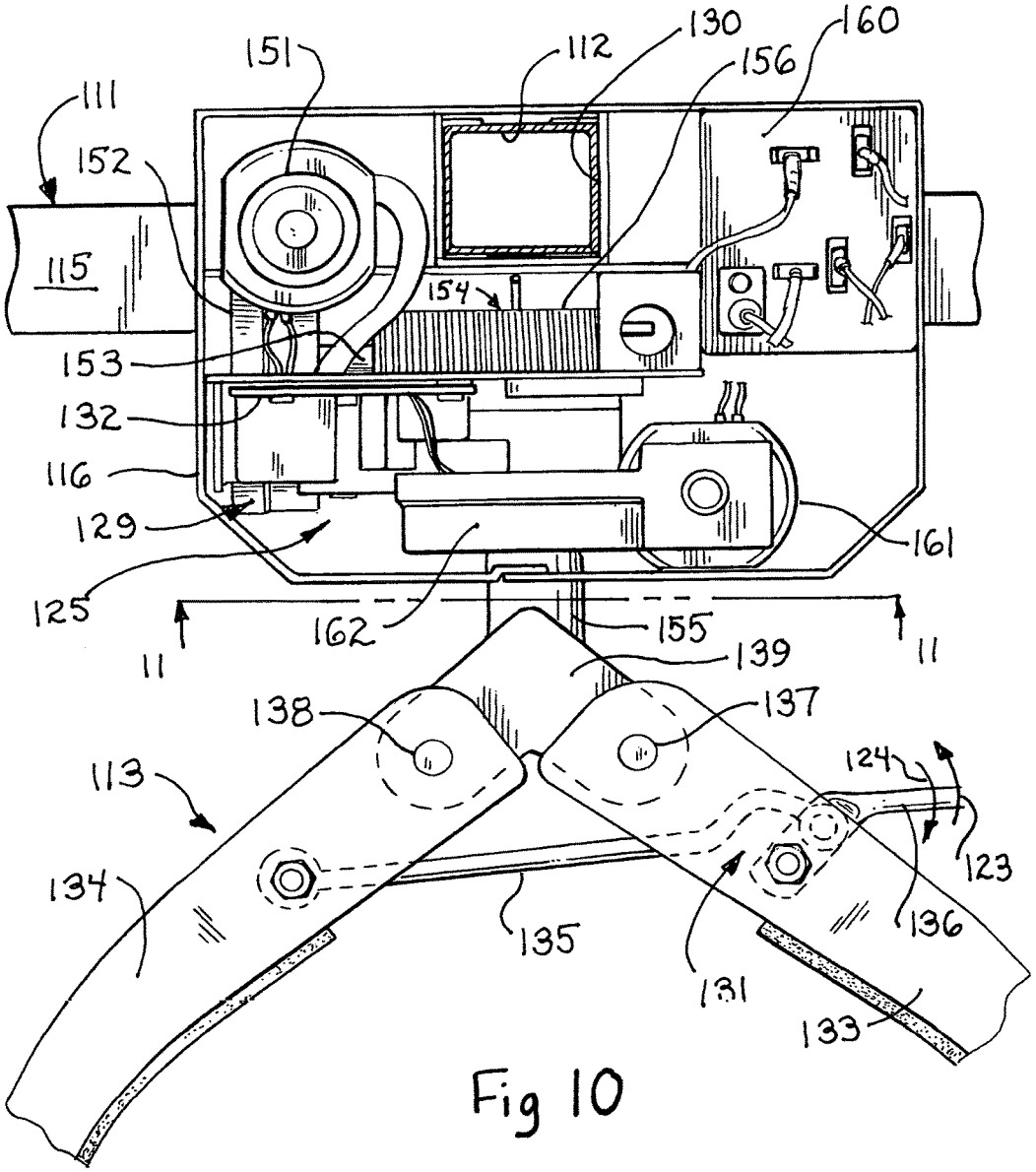
FIG. 10 sets forth a partial top view of the alternate embodiment shown in FIG. 9 illustrating the control unit and over-center clasp mechanism.
Figure 14:
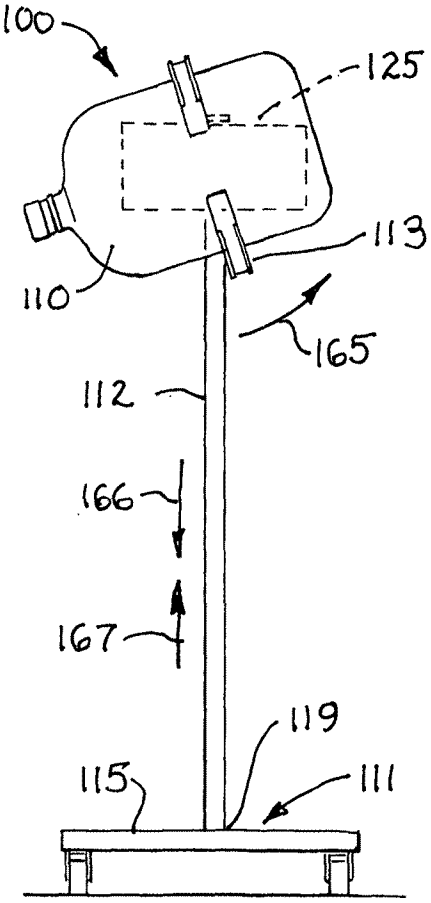
FIG. 14 sets forth a front view of the alternate embodiment shown in FIG. 10 porting a water bottle in a raised and rotated position.
Figure 13:
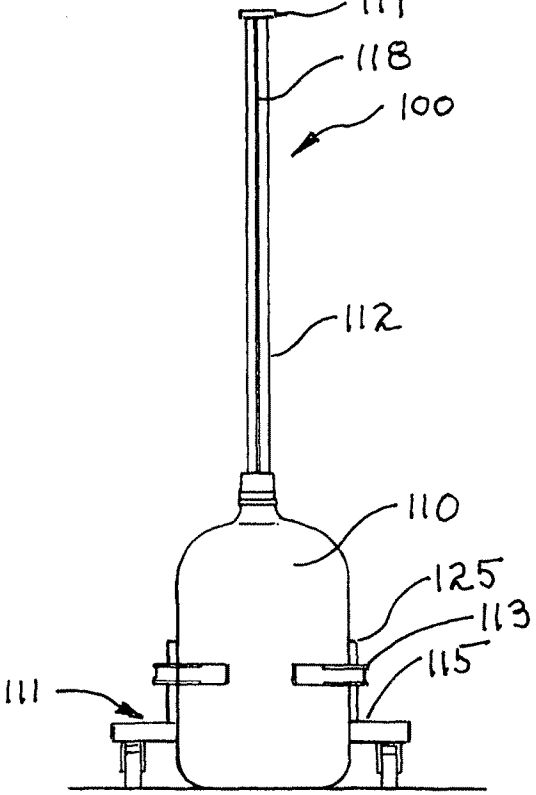
FIG. 13 sets forth a front view of the alternate embodiment shown in FIG. 10 having an illustrative water bottle secured by the bottle clasp prior to lifting the water bottle.

Water bottle lifting and rotating device 100 further includes a bottle clasp 113 having a pair of curved clasp jaws 133 and 134 each pivotably a secured to a pivot block 139 by a pair of pivot pans 137 and 138 (pivot block 139 and pivot pins 137 and 138 better seen in FIG. 10). Pivot block 139 further defines a clasp shaft 155 which is rotatably supported within control unit 125 in the manner better seen in FIG. 10. Suffice it to note here that clasp shaft 155 and pivot block 139 are rotatably supported to facilitate the rotation of bottle clasp 113 to achieve rotation of a supported water bottle for inversion in the manner set forth in FIG. 14. A cable 118 is secured at one end to the upper and of vertical mast 112 proximate top cap 117 by conventional attachment (not shown). The remainder of cable 118 extends downwardly along vertical mast 112 into housing 116 and is thereafter wound upon a cable spool 154 (seen in FIG. 10). Water bottle lifting and rotating device 100 further includes a remote controller 126 constructed in accordance with conventional fabrication techniques which facilitates the operation of water bottle lifting and rotating device 100 from a distance. In accordance with conventional fabrication, remote controller 126 supports a plurality of user operated buttons and communication circuitry which produces communication signals for processing by control unit 125. It will be recognized that remote controller 126 may operate utilizing radio frequency signals, sound energy signals or light energy signals as a matter of design choice. The remote control signals emanating from remote controller 126 are received by conventional signal reception apparatus supported within troll circuit 129 (seen in FIG. 10). The control signals are received and decoded by control circuit 129 within control unit 125 to selectively activate the motor units (seen in FIG. 10) within control unit 125. Thus, the user is able to employ remote controller 126 two raise or lower control unit 125 and bottle clasp 113 in the manner indicated by arrows 147 and 148 upon vertical mast 112. Additionally, the user is able to actuate remote controller 126 to cause rotation of bottle clasp 113 about clasp shaft 155 in the manner indicated by arrows 122. The importance of this rotation of bottle clasp 113 is set forth more clearly in FIGS. 13 and 14. However, suffice it to note here that the rotation of bottle clasp 113 and a water bottle secured therein as is set forth in FIGS. 13 and 14 provides the required bottle inversion described above that is essential to the placing of a water bottle within a water cooler (not shown) of otherwise conventional design.

In operation, water bottle lifting and rotating device 100 is initially configured in the configuration shown in FIG. 9. In this configuration, control unit 125 is positioned at its lowest position and rests upon cross member 115. Clasp 113 is rotated to a horizontal orientation and handle 114 is placed in the horizontal position shown in FIG. 9. Water bottle lifting and rotating device 100 is then moved across the supporting floor surface into proximity to a water bottle (seen in FIG. 13). The user then opens clasp 113 by pivoting latch handle 136 in the direction indicated by arrow 123. The pivoting motion of latch handle 136 releases the latch upon clasp jaws 133 and 134 pivoting the class jaws outwardly in the directions indicated by arrows 142 and 141 respectively. With clasp 113 in its open configuration, the user then positions water bottle lifting and rotating device 100 proximate to a water bottle and further positioned such that the water bottle is within clasp jaws 133 and 134. The user then pivots latch handle 136 in the direction indicated by arrow 124 which as is better described in FIG. 10 closes clasp jaws 133 and 130 or inwardly in the directions indicated by arrows 128 and 127 respectively. At this point water bottle lifting and rotating device 100 secures a water bottle in the manner shown in FIG. 13. The user then actuates remote controller 126 two cause control unit 125 to be raised upon vertical mast 112 to the position shown in FIG. 14. The user then positions water bottle lifting and rotating device 100 against the water cooler aligning the water bottle with the water bottle receptacle of the cooler. The user then actuates remote controller 126 causing control unit 125 to rotate bottle clasp 113 in order to invert the water bottle in the manner indicated in FIG. 14. Once the water bottle is fully inverted, the user then actuates remote controller 126 to lower control unit 125 and bottle clasp 113 in the manner indicated by arrow 148 until the inverted bottle is deposited within the water cooler. As a final step, the user then pivots latch handle 136 in the direction indicated by arrow 123 to release the grip of clasp jaws 133 and 134 and thereby release the water bottle. Once the water bottle is released, the user may then roll water bottle lifting and rotating device 100 away from the cooler leaving the deposited water bottle behind.

FIG. 10 sets forth a partial top view of water bottle lifting and rotating device 100 which facilitates a fuller understanding of the operation of control unit 125. Of particular attention in FIG. 10 is the arrangement of the motors utilized in rotating bottle clasp 113 and raising and lowering control unit 125 upon vertical mast 112. More specifically, water bottle lifting and rotating device 100 includes a base 111 (better seen in FIG. 9) having a cross member 115. As described above, a vertical mast 112 defines a generally square cross-section and extends upwardly from cross member 115. Control unit 125 includes a housing 116 which in turn includes a square cross-section mast sleeve 130. The latter receives vertical mast 112 and the cooperation between vertical mast 112 and mast sleeve 130 facilitates the vertical sliding movement of control unit 125 upon vertical mast 112. Control unit 125 supports a bottle clasp rotation motor 161 which is coupled to a gear drive 162. Gear drive 162 is coupled to a clasp shaft 155. Gear drive 162 preferably includes a conventional "worm gear" drive mechanism which converts the rotational output of bottle clasp rotational motor to rotational movement of clasp shaft 155. In the preferred fabrication of the present invention bottle clasp rotation motor 161 is a bidirectional motor producing output rotational power in either direction of rotation. This, in turn, facilitates rotation of clasp shaft 155 in either direction as desired. Clasp shaft 155 further supports a pivot block 139. Pivot block 139 further supports clasp jaws 133 and 134 of bottle clasp 113. The interior ends of pivot jaws 133 and 134 are pivotably secured to pivot block 139 by a pair of pins 137 and 138 respectively. An over-center latch mechanism is provided by latch rod 135 and latch handle 136. Latch rod 135 is pivotally joined to clasp jaw 134 and extends toward clasp jaw 133. Latch handle 136 is pivotally secured to clasp jaw 133 and is further pivotally secured to the remaining end of latch rod 135. Latch rod 135 and latch handle 136 are shaped to provide an over-center mechanism 131 which is operative upon clasp jaws 133 and 134. As a result movement of latch handle 136 in the direction indicated by arrow 124 moves the connection of over-center mechanism 131 to a snap closure. This ensures that a water bottle clasped between clasp jaws 133 and 134 is securely maintained. Conversely, movement of latch handle 136 in the direction indicated by arrow 123 releases the over-center latch of mechanism 131 and opens clasp jaws 133 and 134.

Control unit 125 further includes an elevation motor 151 supported within housing 116. Elevation motor 151 is coupled to a gear drive 152 which in turn is coupled to a cable spool 154 by a spool shaft 153. A quantity of cable 156 has one and secured to cable spool 154 and a quantity of cable wound upon cable spool 154. As is better seen in FIG. 9, the remaining end of cable 156 passes upwardly from control unit 125 and cable spool 154 to attachment at top cap 117 of vertical mast 112. Thus, with a portion of cable wound upon cable spool 154, rotation of cable spool 154 as elevation motor 151 is activated in a selected direction will either wind additional cable onto cable spool 154 or unwind a portion of cable 156 wound upon tables tool 154. As a result activating elevation motor 151 in a first direction will provide rotational power coupled through gear drive 152 and spool shaft 153 in a direction which whines additional cable upon cable spool 154 causing control unit 125 and bottle clasp 113 to be raised along vertical mast 112. Conversely, activation of elevation motor 151 in the opposite direction will unwind a portion of cable 156 off of cable spool 154 allowing control unit 125 and bottle clasp 113 to be along vertical mast 112. Accordingly, operation of elevation motor 151 in a selected direction will either raise or lower control unit 125 and bottle clasp 113. The raising and lowering of bottle clasp 113 and control unit 125 facilitates raising and lowering a water bottle secured within bottle clasp 113.

Control unit 125 further includes a battery power unit 160 which will be understood to include a battery power supply together with conventional apparatus for recharging the batteries within battery power unit 160. While not seen in FIG. 10, it will be understood that a plurality of conventional electric coupling wires are provided within control supported upon a conventional unit 125 to provide operating power for bottle clasp rotation motor 161 and elevation motor 151.

Control unit 125 further includes a control circuit 129 that includes appropriate motor control circuitry for operating each of motors 151 and 161 in selected directions and at suitable power levels. Control circuit 129 further includes conventional remote control signal receiving and decoding circuitry which facilitates the operation of control unit 125 in accordance with the above described remote control signal communications.

Figure 12:
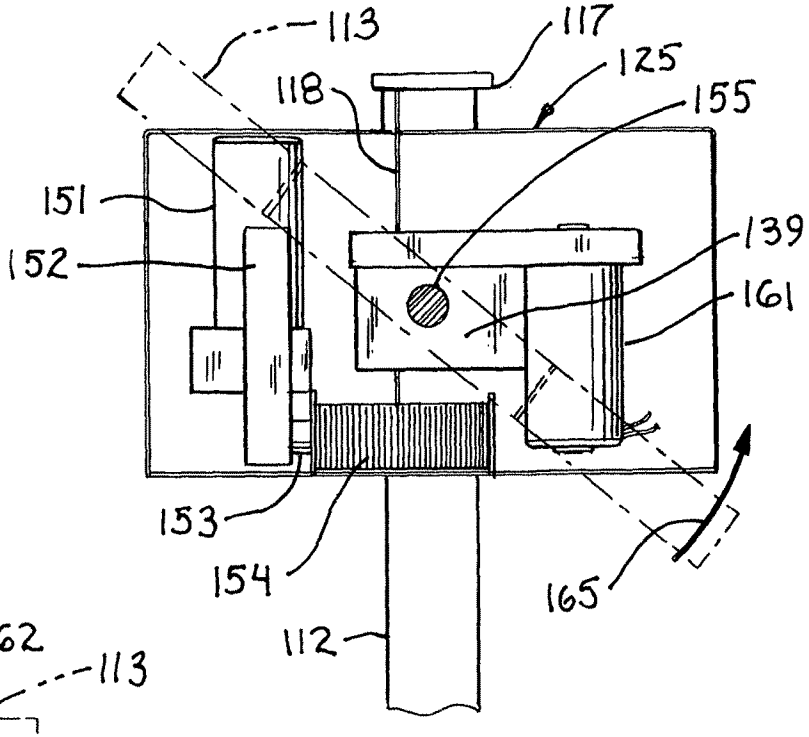
FIG. 12 sets forth a partial section view of the alternate embodiment shown in FIG. 10 taken along section lines 11-11 illustrating rotation of the bottle clasp.
Figure 11:
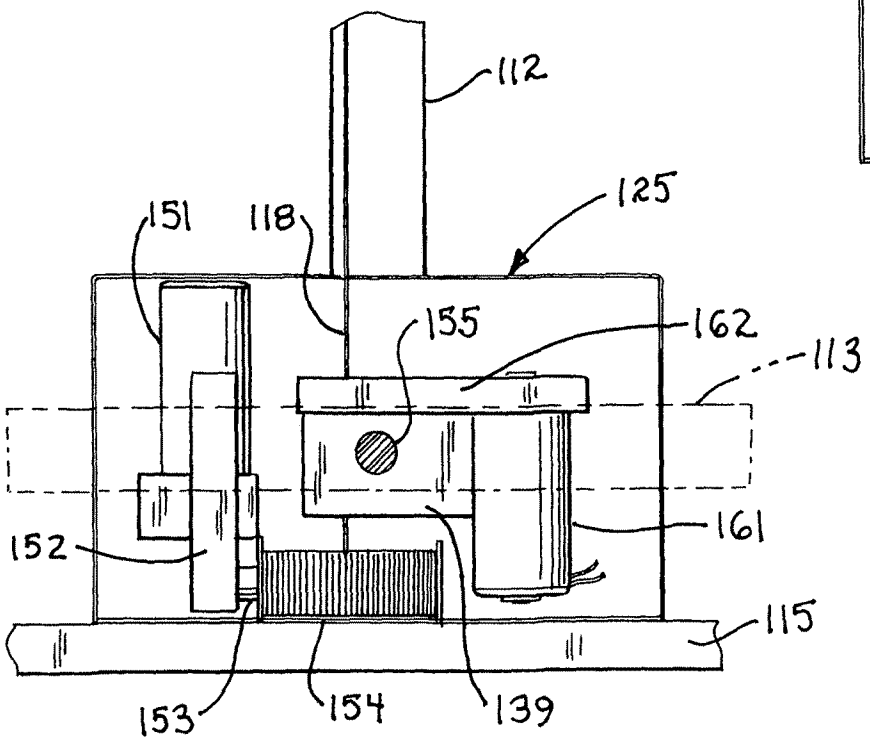
FIG. 11 sets forth a partial section view of the alternate embodiment shown in FIG. 10 taken along section lines 11-11 therein.

FIGS. 11 and 12 set forth in section views of the present invention water bottle lifting and rotating device taken along section lines 11-11 in FIG. 10. FIGS. 11 and 12 are provided to illustrate the rotation of bottle clasp 113 in response to activation of bottle clasp rotation motor 161. It will be recalled that rotation of a water bottles secured within bottle clasp 113 is necessary in order to facilitate inverting the water bottle prior to installation upon a water cooler or other device. FIG. 11 shows control unit 125 of water bottle lifting and rotating device 100 at its lowest position resting upon cross member 115 of base 111. Conversely, FIG. 12 shows control unit 125 of water bottle lifting and rotating device 100 at its raised position upon the upper portion of vertical mast 112.

More specifically, FIG. 11 sets forth cross member 115 supporting vertical mast 112. Control unit 125 includes a housing 116 within which a bottle clasp rotation motor 161 is supported. Motor 161 is coupled to a gear drive 162 which in turn is coupled to a shaft 155. Shaft 155 supports a pivot block 139. Control unit 125 further includes an elevation motor 151 coupled to a gear drive 152 which in turn is coupled to a spool shaft 153. Spool shaft 153 is further coupled to cable spool 154. A cable 118 is wound upon cable spool 154. Pivot block 139 supports bottle clasp 113 shown in phantom line depiction.

FIG. 11 sets forth the position and configuration of control unit 125 at the start of a bottle lifting and rotating operation. Accordingly with control unit 125 lowered to its lowest position resting upon cross member 115 water bottle lifting and rotating device is positioned such that clasp 113 is rotated to a horizontal position and is proximate to a water bottle (not shown). Thereafter, in accordance with the above-described operation the user manipulates latch handle 136 (seen in FIG. 10) to grasp the water bottle in the manner shown in FIG. 13. Once the water bottle has been grasped, elevation motor 151 is activated providing rotational power which is coupled by gear drive 152 and shaft 153 to produce rotation of cable spool 154. As cable spool 154 is rotated cable 118 is wound upon cable spool 154 which in turn raises control unit 125 along vertical mast 112. This rotation continues until the water bottle has been lifted to the upper portion of vertical mast 112.

FIG. 12 sets forth control unit 125 at the top of vertical mast 112. Control unit 125 includes a housing 116 within which a bottle clasp rotation motor 161 is supported. Motor 161 is coupled to a gear drive 162 which in turn is coupled to a shaft 155. Shaft 155 supports a pivot block 139. Control unit 125 further includes an elevation motor 151 coupled to a gear drive 152 which in turn is coupled to a spool shaft 153. Spool shaft 153 is further coupled to cable spool 154. A cable 118 is wound upon cable spool 154. Pivot block 139 supports bottle clasp 113 shown in phantom line depiction.

FIG. 12 also sets forth the rotational position of bottle clasp 113 corresponding to the position shown in FIG. 14. With control unit 125 raised to the position shown in FIG. 12, the activation of bottle clasp rotation motor 161 produces rotation of shaft 155 and bottle clasp 113 in the direction indicated by arrow 165. In the position shown in FIG. 12, bottle clasp 113 is approaching a horizontal position corresponding to the inversion of bottle clasp 113 which in turn provides inversion of the water bottle secured within bottle clasp 113 (seen in FIG. 14).

FIG. 13 sets forth a front view of water bottle lifting and rotating device 100 having a water bottle 110 to supported therein. Thus, water bottle lifting and rotating device 100 includes a base 111 having a cross member 115 porting a vertical mast 112. Vertical mast 112 includes a top cap 117. A cable 118 is secured to the upper and of vertical mast 112 and extends downwardly to control unit 125. A bottle clasp 113 secures a conventional water bottle 110. In the position shown in FIG. 13, control unit 125 and bottle clasp 113 are positioned at their lowest position corresponding to that shown in FIG. 11. Accordingly water bottle 110 is resting upon the supporting floor surface and is not yet lifted by water bottle lifting and rotating device 100.

FIG. 14 sets forth water bottle lifting and rotating device supporting a conventional water bottle 110 that has been raised to the uppermost position of control unit 125. With water bottle 110 fully raised the above described rotation of bottle clasp 113 is initiated rotating bottle clasp 113 and water bottle one tan in the direction indicated by arrow 165. This rotation continues until water bottle one tan has been fully inverted. Once the inversion of water bottle 110 is complete elevation motor 151 (seen in FIG. 12) is activated to lower the combination of control unit 125 and bottle clasp 113 together with water bottle 110 downwardly in the direction indicated by arrow 166. Once the inverted water bottle is lowered into the water cooler, bottle clasp 113 is released and elevation motor 151 is activated to raise control unit 125 upwardly in the direction indicated by arrow 167 after which water bottle lifting and rotating device 100 may be withdrawn from the area.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A water bottle lifting and rotating device comprising;

a base having a pair of parallel support struts, a cross member joined to said support struts, a pair of rear wheels rotatably fixed to said support struts and a pair of casters fixed to said extending base supports;

a mast having an upper end and a lower end secured to said cross member, said mast extending vertically upwardly from said cross member;

a control unit having a control unit housing defining a housing interior and a mast sleeve, said vertical mast received within and sliding within said mast sleeve such that said control unit is movable upon said vertical mast between a lower position upon said cross member and a raised position proximate said upper end, a first motor and a first gear drive supported upon said housing having a drive pulley, said first gear drive operative to cause rotation of said drive pulley, a second motor and a second gear drive supported upon said housing;

a cable having a portion joined to and wound upon said drive pulley, a portion extending upwardly along said vertical mast and a cable end secured to said vertical mast proximate said upper end; and a bottle clasp having a pivot block and a clasp shaft, coupled to said second gear drive, rotatably supported upon said housing, a pair of clasp jaws pivotally joined to said pivot block and an over-center clasp latch operative upon said clasp jaws, said control unit and said bottle clasp being raised and lowered as said first motor is activated to wind more or less of said cable upon said pulley and said bottle clasp being rotatable in response to activation of said second motor.

2. The water bottle lifting and rotating device set forth in claim 1 wherein said control unit includes a remote control signal receiver and wherein said water bottle lifting and rotating device further includes a remote controller for remotely operating said control unit.

3. The water bottle lifting and rotating device set forth in claim 2 wherein said control unit includes a battery power supply within said housing.

4. The water bottle lifting and rotating device set forth in claim 3 wherein said vertical mast further includes a handle shaft joined to said vertical mast proximate said upper and lower ends and wherein said water bottle lifting and rotating device further includes;

a handle;

a handle clamp slidably supported upon said handle shaft securing said handle; and a clasp lever rotatable upon said handle clasp between an open position and a closed position.

* * * * *